United States Patent [19]

Graybill

[11] 4,088,715

[45] May 9, 1978

[54] VARIABLE VENTURI CARBURETOR

[76] Inventor: Clinton Graybill, P.O. Box 396, Superior, Mont. 59872

[21] Appl. No.: 756,018

[22] Filed: Jan. 3, 1977

[51] Int. Cl.[2] ..... F02M 7/02

[52] U.S. Cl. ..... 261/36 A; 261/39 A; 261/44 D; 261/62; 261/72 R; 261/121 A; 261/121 B

[58] Field of Search ..... 261/36 A, 62, 39 A, 261/72 R, 44 R, 121 A, 121 B, 44 D

[56] References Cited

U.S. PATENT DOCUMENTS

| | | | |
|---|---|---|---|
| 719,536 | 2/1903 | Tuttle | 261/72 R |
| 1,011,565 | 12/1911 | Brock | 261/44 R |
| 1,277,963 | 9/1918 | Lovejoy | 261/72 R |
| 1,301,483 | 4/1919 | Miller et al. | 261/121 A |
| 1,313,521 | 8/1919 | Connor et al. | 261/40 |
| 1,322,560 | 11/1919 | Grace | 261/40 |
| 1,441,992 | 1/1923 | Meden | 261/62 |
| 1,626,062 | 4/1927 | Woolson | 261/72 R |
| 1,765,175 | 6/1930 | Pepinster et al. | 261/62 |
| 1,803,150 | 4/1931 | Stokes | 261/121 A |
| 1,845,668 | 2/1932 | Keil | 261/72 R |
| 1,872,555 | 8/1932 | Ball et al. | 261/72 R |
| 1,891,238 | 12/1932 | Oswald | 261/72 R |
| 1,973,362 | 9/1934 | Weiertz et al. | 261/72 R |
| 2,034,048 | 3/1936 | Leibing et al. | 261/44 R |
| 2,134,877 | 11/1938 | Jedrzykowski | 261/121 A |
| 2,291,671 | 8/1942 | Wyss | 261/44 R |
| 2,633,342 | 3/1953 | Baker | 261/72 R |
| 3,085,793 | 4/1963 | Pike et al. | 261/118 |
| 3,985,836 | 10/1976 | Fischer | 261/39 A |

FOREIGN PATENT DOCUMENTS

| | | | |
|---|---|---|---|
| 549,538 | 11/1922 | France | 261/72 R |
| 270,012 | 4/1934 | Italy | 261/62 |
| 524,298 | 4/1955 | Italy | 261/36 A |
| 197,825 | 5/1923 | United Kingdom | 261/62 |

*Primary Examiner*—Tim R. Miles

*Attorney, Agent, or Firm*—Wells, St. John & Roberts

[57] ABSTRACT

A variable venturi carburetor is described that functions in relation to an internal combustion engine to deliver a homogenous mixture of hydrocarbon fuel and air to the engine cylinders in response to vacuum pressure created through the cylinders. The carburetor includes axially movable venturi members for effectively changing the air volume entering through the primary air duct. Provision is made for maintaining a preselected volume of raw fuel available in a reservoir for instantaneous delivery in response to demand created through various throttle opening conditions. In addition to this feature, I provide mechanism by which the air-fuel ratio is appropriately adjusted automatically in response to changing throttle positions. This is done by changing the "head" or distance from the fuel reservoir level to the fuel outlet orifice, thereby changing the pressure requirements for drawing the fuel from the reservoir to the outlet orifice. A further provision is made in the form of a barometric sensing device that is operatively connected to the carburetor in order to automatically vary the air-fuel ratio in response to varying air pressure conditions at various altitudes.

34 Claims, 7 Drawing Figures

FIG 2
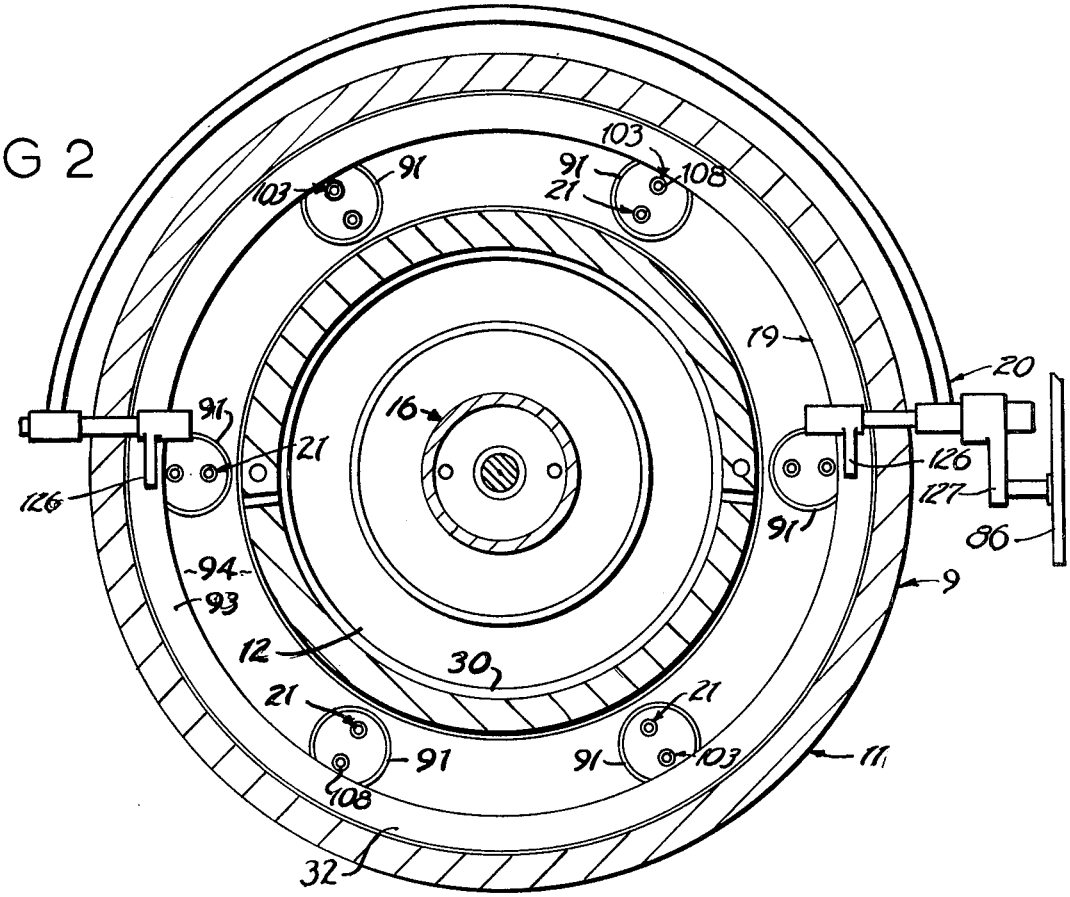
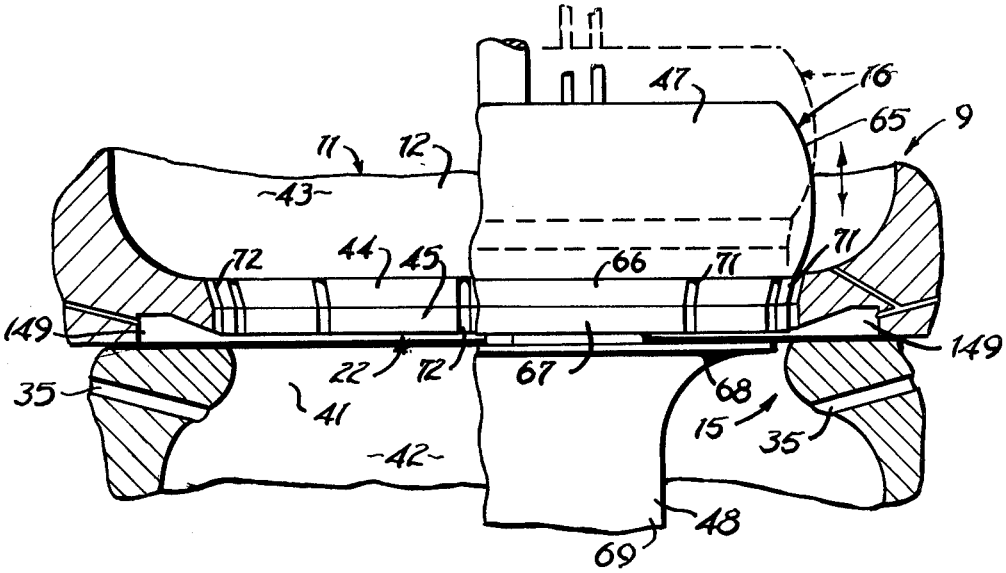
FIG 3

FIG 4
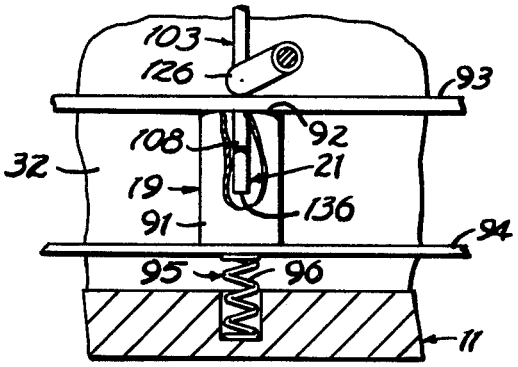
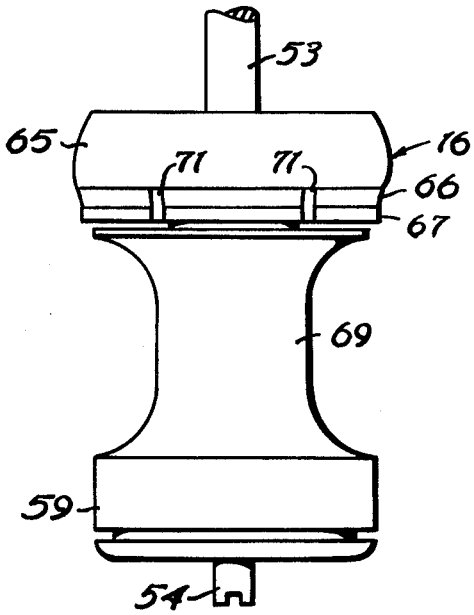
FIG 5

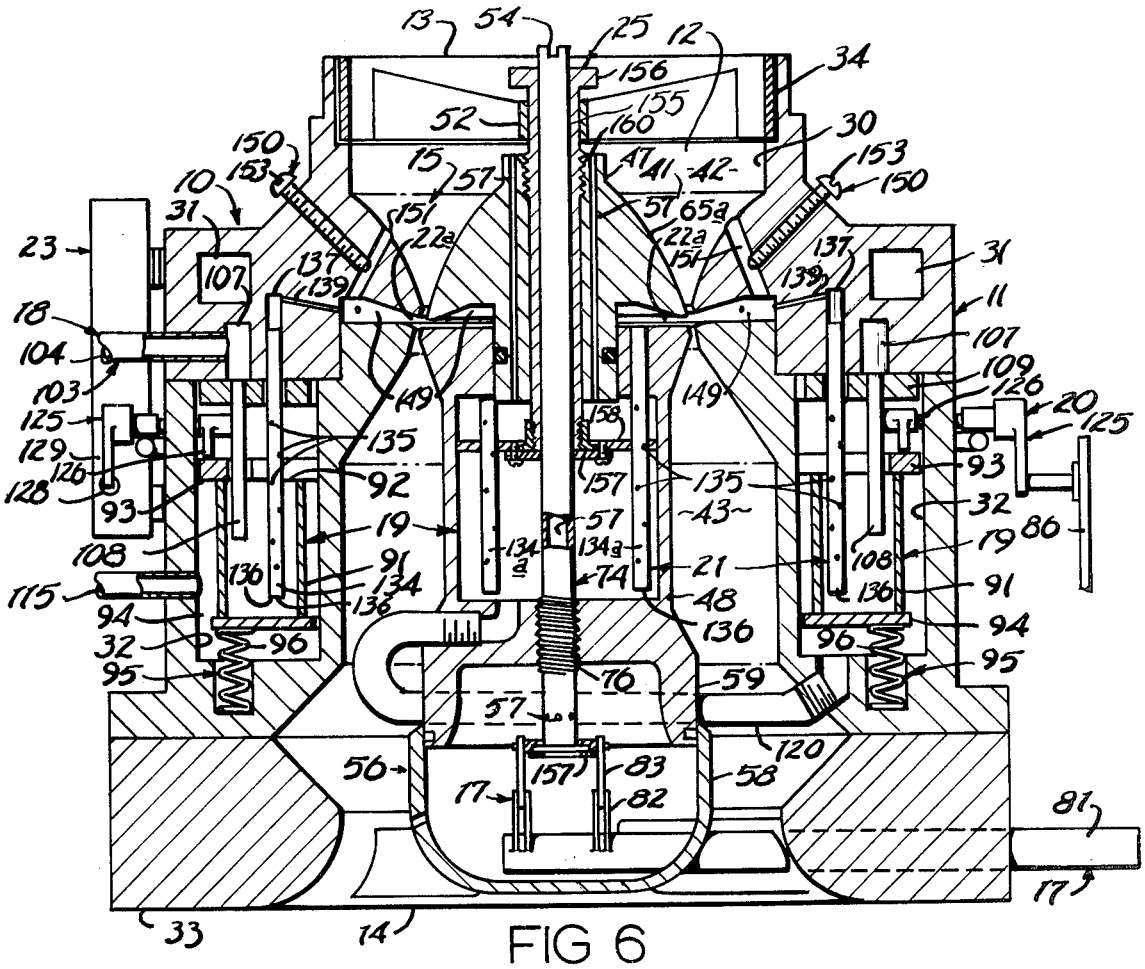
FIG 6
FIG 7
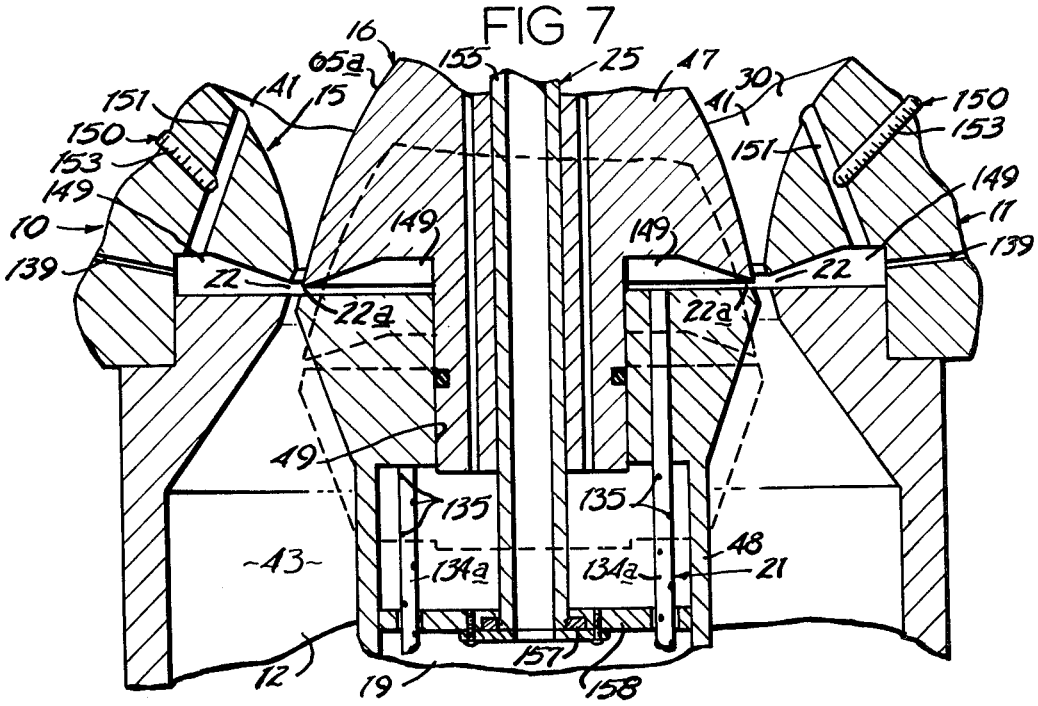

VARIABLE VENTURI CARBURETOR

BACKGROUND OF THE INVENTION

The present invention relates basically to the field of carburetion for internal combustion engines and more particularly to carburetors utilizing a variable venturi in place of the conventional butterfly type arrangement and fixed venturi.

Most present automobile carburetors are designed with a fixed venturi to create a designated vacuum pressure within the induction duct in order to pull hydrocarbon fuel from a fuel reservoir. The fuel reservoir is usually an integral portion of the carburetor and is supplied with raw fuel from the fuel supply tank through a volumetric control arrangement utilizing a float and associated valve mechanism. In sophisticated carburetors, more than one chamber is provided with additional float assemblies, primarily for the reason that the fuel level fluctuates drastically as the associated automobile changes position while cornering or going up or downhill. By situating the float chambers on opposite sides of the carburetor, this problem is alleviated to some extent. Obviously the design consideration involved is that the more chambers utilized, the better the control of the fuel level within the multiple chambers during various physical changes occurring during climbing, descending, cornering, acceleration, deceleration, and other situations wherein fuel level fluctuations may be expected.

An additional problem remains with the conventional float system regardless of the number of individual floats and reservoir chambers provided. This problem is that the selected fuel level is maintained continuously only when the engine is operating at a steady RPM level. When demand is suddenly placed on the reservoir for additional fuel (occurring when the operator suddenly depresses the accelerator to the floor) the fuel level will correspondingly drop as the fuel is used. This lowers the float which finally opens the float valve wider. It is precisely at this phase of operation when the fuel level should be at its highest point and maintained at that point in order to answer to the demands of the full throttle condition. Otherwise the engine will struggle for a period of time until the float valve opens a sufficient amount and the fuel pump is allowed to operate to deliver the demanded fuel directly to the fuel discharge orifice of the carburetor. Thus, it may be easily understood that it would be very desirable to obtain some form of carburetion system whereby a continuous volume of fuel is maintained at all times regardless of engine operating conditions in order that an immediate fuel supply is available in response to any demand placed on the fuel delivery system by sudden changes in the throttle setting.

The fixed venturi form of carburetor, by its nature, operates at a maximum efficiency only over a relatively small range of engine RPM. Furthermore, a different size venturi is generally required for different performance requirements. Automobiles are seldom operated in the restricted range of RPM in which the fixed venturi operates at maximum efficiency. Consequently, various complicated venturi arrangements including multiple venturi tubes have been included in carburetors in attempts to make the carburetor more efficient over a wider range of operating conditions. Often, an accelerator pump is provided in addition to multiple venturi tubes to operate in response to sudden depression of the throttle pedal. Such accelerator pumps usually function to pump large amounts of raw fuel directly into the air moving through the venturi. Accelerator pumps are responsible for a tremendous loss of usable fuel that is simply carried through the engine and entered into the air as unburned hydrocarbons. They therefore result in poor fuel economy and generally increase the pollution output of a possibly cleaner burning engine.

It may be seen then that additional features added to existing fixed venturi carburetors frequently are the source of additional inefficiencies that often do more harm than the good they were intended for. Nearly all the additional features on the contemporary complex carburetors are designed to compensate for the inefficiency of the venturi over the full range of operating conditions and RPM. Ideally, a carburetor should operate at maximum efficiency over the full range of engine operating RPM and load conditions.

Conventional air valve type carburetors have been utilized in an attempt to maintain a constant air velocity across a fuel jet orifice independent of the throttle valve position and engine speed. Such carburetors are designed in an attempt to vary the size of the fuel jet in accordance with the amount of air entering the carburetor to therefore provide a correct "air-fuel rato." Engines having such air valve carburetors are generally difficult to start and to operate at idling RPM.

One of the primary objects of this invention is to provide a variable venturi carburetor that is capable of effectively premixing the fuel and air over the full range of engine operation prior to emittance of the fuel into the main air duct of the carburetor.

Another object of this invention is to provide a variable venturi carburetor that is capable of automatically adjusting the fuel and air in response to the engine demand while continually premixing the fuel and air prior to induction into the throat of the variable venturi.

A further object is to provide a variable venturi carburetor that utilizes an annular fuel orifice circumscribing the main induction duct and utilizing heat and vacuum pressure to effectively premix the fuel vapors and air prior to passing the premixture through the annular orifice into the main induction duct.

One object of the present invention is to provide a variable venturi carburetor that includes a float system wherein a fuel level may be maintained regardless of the running condition of the associated engine to thereby provide a ready supply of fuel regardless of demand from the engine.

Another object is to provide such a carburetor wherein there is included a fuel reservoir that is not adversely affected by acceleration forces exerted on the carburetor which occur when the vehicle accelerates, decelerates and turns a corner.

A still further important object is to provide such a carburetor that includes a fuel mixture control means by which the fuel-air ratio is changed in response to differing throttle positions. Thus, at a full throttle or in an extreme accelerating condition, a rich supply of fuel is delivered to the primary airstream passing through the carburetor, while at idle speeds, the ratio is allowed to change through functioning of the mixture control means and specially provided idle air and fuel systems to produce the proper ratio of fuel to air during idle conditions.

A further object is to provide such a carburetor that relies only upon axial movement of a central venturi member to control different throttle settings of the carburetor and is not dependent upon a conventional form of butterfly throttle valve.

A yet further object of my invention is to provide such a carburetor that may be utilized as either an updraft or a downdraft form of carburetor.

A still further object is to provide such a carburetor that, in a modified form may provide even greater area of discharge for premixed air and fuel by providing two oppositely facing fuel discharge orifices.

An additional object is to provide such a carburetor that is extremely simple in construction in relation to conventional carburetors, and that is therefore relatively easy to maintain and adjust, and is also easy to manufacture and inexpensive to purchase.

An additional object is to provide such a carburetor that is easily adapted to be mounted on a great variety of internal combustion engines without requiring substantial modification thereof.

These and still further objects and advantages will become evident upon reading the following detailed description which, taken with the accompanying drawings, discloses a preferred form of my invention. However, it is to be understood that the following description is given merely by way of explanation of a preferred and alternate form of my invention and that various changes and modifications may be made therein without departing from the intended scope of my invention. Thus, only the claims to be found at the end of this specification are to be taken as definitions of my invention.

BRIEF DESCRIPTION OF THE DRAWINGS

Preferred embodiments of my invention are illustrated in the accompanying drawings in which:

FIG. 2 is a sectioned view taken substantially along line 2—2 in FIG. 1;

FIG. 3 is an enlarged fragmentary view illustrating important components of my invention and their interacting relationships;

FIG. 4 is another fragmentary sectional view illustrating further components of the present carburetor;

FIG. 5 is a detail view of an important element of my invention;

FIG. 6 is an elevational view of a downdraft version of the present carburetor; and FIG. 7 is a view similar to FIG. 3 only illustrating the corresponding components of the form of carburetor illustrated in FIG. 6.

DETAILED DESCRIPTION OF PREFERRED AND ALTERNATE EMBODIMENTS

Figure 1:
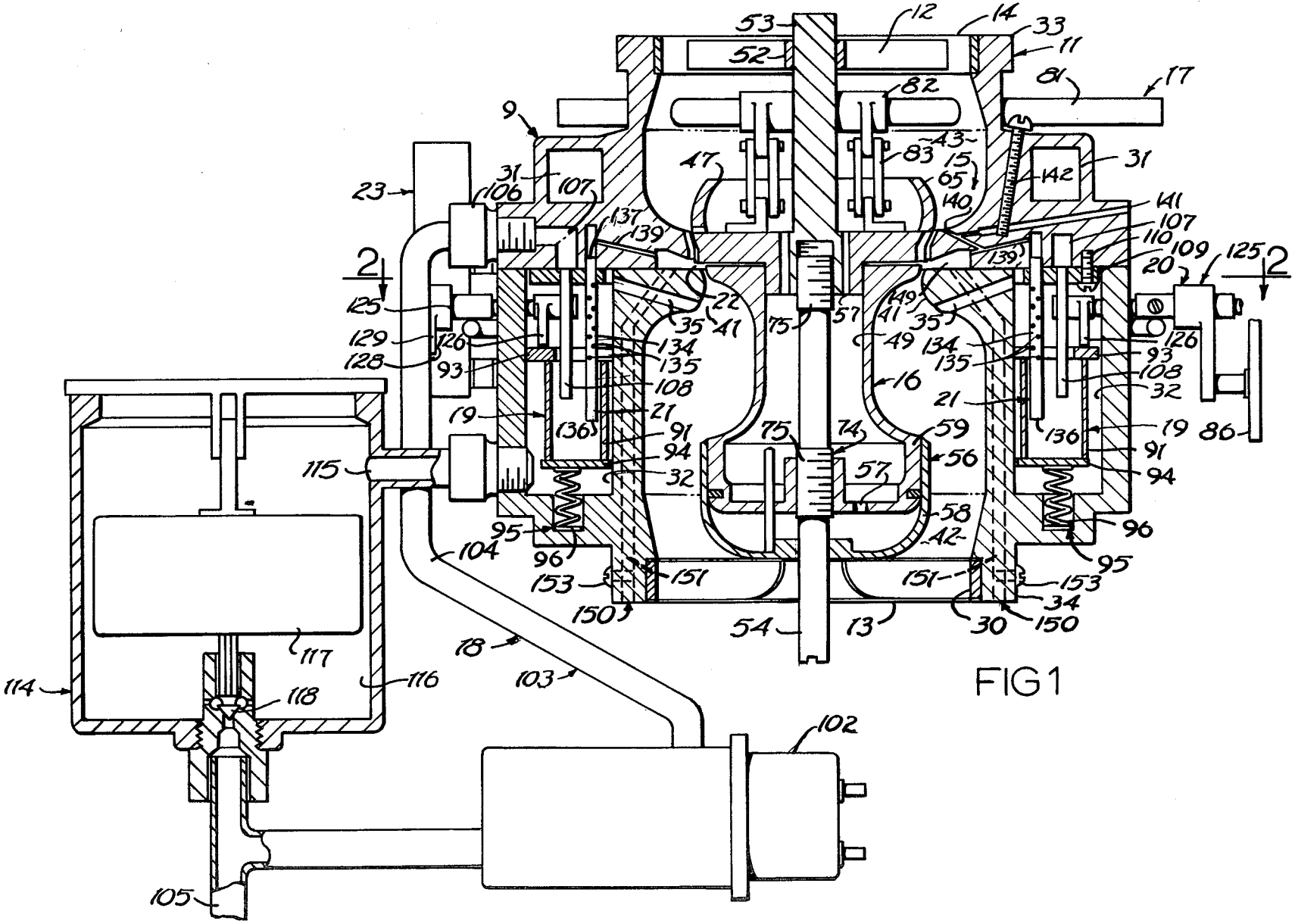
FIG. 1 is an elevational sectioned view of an updraft version of the present invention.

Referring now in detail to the drawings, there is illustrated a variable venturi carburetor for mixing fuel with an airstream to form a combustible mixture prior to induction into combustion chambers of an internal combustion engine. FIGS. 1–5 illustrate an updraft version 9 of the carburetor in which the airstream passes upward through an air duct 12. FIGS. 6 and 7 illustrate a downdraft version 10 in which the airstream passes downward through the carburetor. It is noted that the versions are shown merely by way of example and that both can be relatively easily redesigned to operate either as an updraft or a downdraft form of carburetor.

Both carburetors 9 and 10 include an elongated hollow body 11. Body 11 defines a central longitudinal open air duct 12 that extends from an air intake end 13 to a discharge end 14. Duct 12 has an annular wall surface that defines a first venturi member 15. A second venturi member 16 is centrally located within the duct 12 coaxial with first venturi member 15. A throttle means 17 is provided, operatively interconnecting the two venturi members in order to move them axially relative to one another.

A fuel supply means 18 is also included and is operatively connected to the throttle means 17 and hollow body 11. Supply means 18 operates in association with a fuel reservoir means 19 to deliver fuel on demand in response to the operation of throttle means 17. Reservoir means 19 is utilized to receive and store a premeasured supply of liquid hydrocarbon fuel. A fuel mixture control means 20 is associated with reservoir means 19 and a fuel suction tube means 21 within the hollow body 11. Fuel suction tube means 21 extends downwardly into the reservoir means 19 to receive fuel and air therefrom and deliver it upwardly premixed to an annular fuel outlet orifice 22, and in the version shown in FIG. 6, an opposing annular orifice **22*a*. The elevational distance between the fuel level within the reservoir means 19 and the annular outlet orifice 22, 22*a* is variable through operation of the mixture control means 20**.

The effective distance between the fuel level and outlet orifices 22, **22*a* may be automatically varied through operation of a barometric pressure sensing means 23. Means 23 is operatively connected to the mixture control means 20 in order to adjust the effective distance between the fuel level in the reservoir means 19 and the orifice 22 to thereby adjust the air-fuel ratio in response to altitudinal changes of the carburetor. Means 23** adapts the carburetor to various climatic conditions to thereby enable the engine to operate at a continuous optimum efficiency.

Another general feature of the present invention is the provision of an orifice aperture adjusting means 25. It may be utilized with both versions of the invention to change the axial gap between edges of the annular orifice(s). By doing so, the user is capable of adjusting the fuel delivery characteristics of the caburetor. Other adjustments are provided and will be discussed below in the more detailed discussion of the above generally described features.

The hollow body 11 of carburetors 9 and 10 may be formed in several castings and assembled by conventional fastening mechanisms to produce the arrangements as shown in FIGS. 1 and 6. As shown, the hollow body 11 includes annular elongated interior wall 30 that defines the air duct 12. A section of the wall 30 has a surface that defines the first venturi member 15. An annular water jacket 31 is formed in the body 11 and extends about the duct 12 and is adapted to receive heated water from the internal combustion engine to dissipate the heat therefrom into the surrounding carburetor body. Jacket 31 is located in close proximity to the annular orifice 22 in order to heat the fuel and air mixture at that point. This assists vaporization of the fuel without "percolating" the fuel in the reservoir means 19 (a problem inherent in conventional carburetor heaters).

Axially spaced from the water jacket 31 is an enclosed annular chamber or bowl 32. Chamber 32 is utilized to receive at least a portion of the fuel reservoir means 19. Chamber 32 is sealed with the exception of a number of air vent ducts 35 (FIG. 1) that open into the primary air duct 12 at atmospheric pressure.

The hollow body 11 includes an engine intake manifold mounting flange 33 at the discharge end 14. Opposite the end 14, and adjacent the intake end 13, is an air cleaner mounting flange 34. Both flanges 33 and 34 may be manufactured differently according to the requirements of the engine. There is little difficulty in adapting the present carburetor structure to fit substantially any form of internal combustion engine without modifying the intake manifold thereof.

The first venturi member 15 is formed by a convex surface 41 that is formed intermediate ends 13 and 14 of air duct 12. Surface 41 substantially divides the air duct 12 into an upstream air horn section 42 and a downstream mixing chamber section 43, located between surface 41 and the discharge end 14.

The surface 41 includes an annular beveled conical shoulder portion 44, (FIG. 3) and an adjoining cylindrical portion 45. These two annular surfaces are provided to coact with complementary surfaces on the second venturi member 16.

The second venturi member 16, in both preferable forms of the carburetor, is of a substantial "hour glass" configuration and is axially movable within the air duct 12 relative to first venturi member 15. In an alternate embodiment the second venturi member 16 could be held stationary while the throttle means is operated to axially move the first venturi member. This could be accomplished by simply modifying the body such that the first venturi member is provided in the form of a movable sleeve attached to the throttle linkage.

The second venturi member 16 is illustrated in somewhat varying forms by FIGS. 1 and 6. However, both illustrated forms include two separate interfitting elements that, together, make up the entire second venturi member 16. A first element 47 is situated within the air horn portion 42 in FIG. 1 and in the mixing chamber in FIG. 6. Element 47 is interconnected with element 48. The two elements 47 and 48 are slidably interconnected for adjustment purposes to enable idle setting of the carburetor. Element 48 includes a substantially cylindrical bore 49 that receives a complementary portion of the downstream element 47.

Both elements 47 and 48 are held coaxially within the air duct 12 by guide sleeves 52. In FIG. 1, the sleeves 52 receive a guide rod 53 at one end and the shank of an elongated idle adjusting rod 54 at the opposite end. Idle rod 54 is threadably connected to guide rod 53. In the embodiment shown in FIG. 1, the guide rod 53 is an integral component of the venturi element 47. However, in the form shown in FIG. 6, a separate sleeve 155 (described more fully below) is utilized in axially guide venturi member 16 by sliding within the sleeves 52.

A pressure equalizing means 56 is provided to prevent the vacuum present within the mixing chamber area from acting against the second venturi member to pull it toward an open or full throttle condition. Means 56 is illustrated in variations of the same general form in FIGS. 1 and 6. Basically, the equalizing means 56 is simply comprised of vent passageways 57 formed in element 47 to equalize the pressure. The venturi element 48 shown in both FIGS. 1 and 6 include a plunger end 59 that is slidably received within a stationary bowl 58. An "O" ring 60 is provided to assure an airtight seal between plunger 59 and bowl 58. An air space between the plunger and bowl is open to the vent passageways 57. Thus, in FIG. 1, the vacuum pressure from the associated engine cylinders is applied to both sides of a substantial cross section of the total venturi member. In FIG. 6, the particular arrangement also enables a pressure equalizing situation to minimize the surface area against which the vacuum will operate. Consequently, there is no need to make special provisions in the throttle means 17 to resist the otherwise substantial forces that would normally be produced against the second venturi member 16.

In FIG. 1, the exterior curvature of second venturi member 16 includes a convex surface 65 on the element 47 (see FIGS. 3 and 5). Surface 65 leads upstream to a beveled surface 66 that is complementary to the beveled shoulder 44 on first venturi member 15. Beveled surface 66 is joined by an annular cylindrical surface 67 (matching the similar cylindrical portion 45 of first venturi member 15). An enlarged shoulder 68 of the element 48 is located directly adjacent element 47. Shoulder 68 plays an important role in the idling function of the carburetor version shown in FIG. 1. A concave midsection 69 leads upstream from shoulder 68 on the upstream element 47 of the second venturi member 16. Concave midsection 69, as shown in FIG. 3 in the dashed line position, substantially increases the cross section of the throat past the annular fuel outlet orifice 22.

FIGS. 3 and 5 illustrate an idle air means formed by a number of angularly spaced axial grooves 71 formed through the beveled surface 66 and cylindrical surface 67 of second venturi member 16 and complementary grooves 72 formed integrally within the beveled shoulder 44 and cylindrical portion 45 of the first venturi member 15. Grooves 71 and 72 match to define the idle air means that lead past the orifice 22.

Similar provision may be made in the version shown in FIGS. 6 and 7. Alternatively, the idle air means may be formed simply by positioning the venturi members in close relation (solid lines, FIG. 7). The restricted throat cross section thus formed may be substantially equal to the area formed by grooves 71 and 72.

In order to adjust the idle speed settings, both versions of the present carburetor include an idle adjusting means 74. Although the versions are somewhat different in configuration, both have substantially similar functions. In FIG. 1, the elements of venturi member 16 are interconnected by the idle adjusting means 74. They are interconnected by threaded portions 75 of the idle adjusting rod 54. The threaded portions 75 engage matching threaded sections 76 of the venturi elements 47 and 48. The threads are turned in opposite directions so by rotating the idle adjusting rod 54, the elements 48 and 47 will move in unison with respect to venturi member 15. In doing so, the restricted throat area is adjusted between the enlarged shoulder 68 of the upstream venturi half 47 and the laterally adjacent convex surface 41 of first venturi member 15. While the idle air grooves 71 and 72 remain of the same dimension during idle settings, the restricted air flow upstream of the passages can be selectively adjusted through provision of the idle air adjusting means 74.

The version shown in FIGS. 6 and 7 operates on a variation of the provisions described above. Here, where the two annular fuel outlet orifices 22, **22*a* are provided, the idle speed is adjusted simply by turning the central idle adjusting rod 54*a*. The rod 54*a* in this version is threadably connected at 76 to the second venturi member 16 and to the throttle means 17. Rod 54*a* operates against the throttle means to selectively change the axial position of the venturi member 16 in relation to the first venturi member 15**. As may be understood from FIG. 7, such adjustment would effectively change the cross-sectional throat area of the air passage between the venturi members at idle setting and thus affect the idle speed of the associated engine.

The throttle means 17 is simply comprised of an accelerator connector rod 81 that extends into the air duct 12 and connects to the first venturi member through a crank arm 82 and connecting links 83. A link 86 is provided between the mixture control means 20 and throttle means 17. Again, both versions of my carburetor use approximately the same form of throttle linkage, the primary difference being merely that the linkage is located in the downstream position (relative to venturi member 16) in FIG. 6 and in an upstream position in FIG. 1. The interconnection between the linkage shown in FIG. 6 and the second venturi member 16 is slightly different is design to accommodate the idle air adjusting means 74.

Both forms of carburetors utilize a fuel reservoir means 19. The same mechanism is utilized in both forms except that the version shown in FIGS. 6 and 7 includes an inner first portion and an outer second portion. The two portions are interconnected and operate upon essentially the same principles. The outer reservoir portion is comprised of a series of individual angularly spaced fuel wells 91 (FIG. 4) positioned within the fuel bowl 32. The wells 91 include upper open edges 92 and are connected at edges 92 by an annular ring 93. Another annular ring 94 seals the bottom edges of the several fuel wells 91. Ring 94 rests upon a biasing means 95 in the form of a plurality of coil springs 96. The wells 91 may be moved axially against resistance of the springs 96.

Reservoir means 19 is intended to receive a supply of fuel from the fuel supply means 18.

Fuel supply means 18 is adapted for connection to a standard form of fuel pump 102 (FIG. 1). The pump 102 is connected directly to the reservoir means 19 by an unrestricted flow means 103. Means 103 includes an open delivery tube 104 that extends from pump 102 to join with a fitting 106 on the carburetor body 11. A fuel receiving tube 105 leads from the intake end of the pump 102 to the associated fuel supply tank. Tube 105 opens into a float valve means 114 that will be discussed below.

The delivery tube 104 is connected to the carburetor body 11 in order to deliver fuel to an inner annular raw fuel manifold 107 that is formed about the air duct 12. The raw fuel is drained from the manifold 107 into the reservoir means 19 through a plurality of individual fuel delivery spouts 108. There is a spout 108 for each of the individual wells 91. Spouts 108 are affixed to the carburetor body by an annular retainer ring 109. One or more retaining screws 110 serve to firmly fix the ring 109 and spouts 108 to the carburetor body.

The float valves means 114 is located exterior to the basic carburetor body 11. It may be located at relatively any convenient position on the associated engine that is elevationally below the reservoir means 19 and above the fuel pump 102. Float valve means 114 is connected to the carburetor through a drain tube 115. Tube 115 is openly connected to the annular fuel bowl 32.

The drain tube 115 opens directly into a float chamber 116. Fuel entering the float chamber will accumulate in the closed bottom portion of chamber 116 until it comes into contact with and subsequently lifts a float 117. A valve 118 is connected to the float 116 such that as the float is elevated, the valve opens and allows the fuel to drain into the fuel tank delivery tube 105 and subsequently back to the fuel pump 102.

The drain tube 115 of the version illustrated in FIGS. 6 and 7 is elevated slightly above the bottom of the bowl 32 to drain fuel from the bowl 32 back into the fuel supply means 18. It is preferable to utilize a fuel pump 102 having an output capacity slightly greater than the maximum fuel demand at the engine. Consequently the fuel reservoir 19 is being fed with more fuel than the wells 91 can hold and a portion of the fuel overflows the upper edge 92 of the wells 91 and drains into the bowl 32 for recycling back to the float chamber 116. In this manner the fuel level within the wells 91 is maintained constant independent of the engine demand. In the second version (FIGS. 6 and 7) the inner portion of the fuel reservoir 19 is interconnected to the bowl 32 by a coupling 120. Consequently the fuel levels within the inner and outer portions are maintained constant regardless of the relative axial position of the second venturi member 16 within the duct.

The fuel mixture control means 20 includes the earlier disclosed biasing means 95 and other associated mechanism for selectively changing the elevation of the fuel wells 91 within the bowl 32 and effectively varying the distance between the fuel level and the level of the fuel outlet orifice 22, **22*a*. Elevational change of the individual fuel wells 91 within the bowl 32 is accomplished through a control linkage 125. Linkage 125 includes two interconnected spaced cams 126 (FIGS. 2 and 4) that together are connected to a bell crank 127. Bell crank 127 is connected through the link 86 to the throttle means 17. The throttle means can operate through the link 86 to vary the distance between the orifices 22 and 22*a* and the fuel level in response to different throttle settings. For example, at a full throttle position, the linkage causes the cams 26 to pivot upwardly as viewed in FIG. 4, to allow the fuel wells 91 to move upwardly (as urged by springs 96) in relation to the fuel suction tube means 21. This movement decreases the distance between the fuel level and fuel outlet orifice 22 causing less fuel to be delivered to the air duct 12**.

Fuel mixture control means 20 is also associated with the barometric pressure sensing means 23. The pressure sensing means 23 is of a substantially conventional form that functions to move an actuator rod 128 in response to variations of air pressure. The actuator rod 128 is positioned to operate against a lever arm 129. Arm 129 is interconnected with the control linkage 125 to move the linkage in response to lateral motion of the actuator rod 128. Consequently the distance between the orifice 22 and **22*a* and the fuel level may be varied either by the pressure sensing means 23 or the fuel mixture control means 20** or both.

Fuel suction tube means 21 is comprised of a plurality of individual upright tubes 134. Each tube includes an axially spaced group of apertures 135 that openly communicate with the hollow tube interiors. Each tube also includes an open lower end 136 that extends downwardly into an associated fuel well 91. The carburetor version of FIGS. 6 and 7 utilize similar tubes **134*a* that depend into the open central reservoir chamber portion. Upper ends 137 of the tubes 134 are substantially fixed to the carburetor body while the tubes 134*a* may be fixed to the lower half of the second venturi end with open upper ends 137 openly communicating with the associated outlet orifice 22*a***.

The outer or peripheral tubes 134 are in open communication at their upper ends 137 with lateral ducts 139 that lead to the fuel outlet orifice 22. As shown in FIG. 1, one or more of these ducts 139 may be interconnected with a bypass idle fuel duct 140 that empties into the duct 12 downstream of the orifice 22. The fuel duct 140 is connected to an air bleed 141 that opens to the outside air. A needle screw 142 is provided in the air bleed passage 141 in order to vary the amount of air supplied to the bypass idle fuel delivered through duct 140. By operating the needle screw 142, the air-fuel ratio of the idle mixture may be selectively varied for low speed operation.

Between the open ends of the tubes 134, 134*a* and orifices 22, 22*a* are annular premixing chambers 149. Each chamber 149 is concentric with the corresponding orifice 22, 22*a* and is provided to facilitate substantial vaporization of the fuel and premixing of the fuel and air prior to its delivery to the air duct 12. High velocity air passing by the orifices 22, 22*a* create a turbulence within the chambers 149 and, as a result, serves to enhance premixing of the air and fuel in chambers 149.

An air bleed means 150 is provided, interconnecting the air horn area of the duct 12 with the outer annular chamber 149 (in first venturi member 15). Although no provision is shown for such a bleed mechanism for the inner premixing chamber 149 (on second venturi 16 of FIG. 7) it is noted that one or more could be provided. The airbleed means 150 is comprised of one or more ducts 151 that open on one end to the outside air. The other end opens into the premixing chamber 149. A threaded screw or needle valve 153 is threadably engaged with the carburetor body and intersects the individual ducts 151 to enable selective adjustment of the amount of air bled from the air horn portion of the carburetor into the premixing chamber.

The orifice adjusting means 25 is shown only on the venturi member 16 of the carburetor version shown in FIGS. 6 and 7. It is understood however, that means 25 could be provided for both orifices 22, 22*a*.

Orifice adjusting means 25 includes the adjusting sleeve 155 (briefly mentioned above) that is threadably connected with the upstream element 47 of venturi member 16. Sleeve 155 includes an outer end that is provided with a head 156 adapted to receive an appropriate adjusting wrench. Sleeve 155 is rotatably carried within an adjacent guide sleeves 52 and, in turn, rotatably receives the idle adjusting rod 54. The lower end of sleeve 155 is provided with a shoulder 157 that is rotatably carried by braces 158 extending from interior walls of the downstream venturi element 48. Braces 158 prevent axial movement of sleeve 155 but allow free rotation. A threaded portion 160 of sleeve 155 is threadably engaged in a similarly threaded portion of venturi element 47 such that rotational movement of sleeve 155 will cause axial sliding movement of the upstream element 47 in relation to the downstream element 48. This movement varies the axial size of the orifice 22*a*. The adjusted size of the orifice opening will be maintained regardless of axial movement of the complete venturi member 16 since the sleeve 155 will slide axially over the idle adjusting rod 54 when idle settings are being made. Thus idle adjustment (through rod 54) may be made entirely independently of orifice adjustments.

The above has been given as a technical description of the invention and, to avoid confusion, has not dealt with the specific function of the relative components in any great detail. The following then, will provide an understanding of the interrelationships of the component parts during operation of the present carburetor assembly.

Firstly, we must assume that the carburetor (either form illustrated) is mounted to the intake manifold of an internal combustion engine and that it is connected appropriately to the engine's fuel supply system and throttle linkage. Thus, when the ignition system is activated, the fuel pump 102 will be operated to receive fuel through the tube 105 and deliver it through tube 104 into the carburetor. The fuel enters the annular manifold chamber 107, and from there, is delivered through the individual depending spouts 108 into the several fuel wells 91.

It is noted that as long as the ignition remains in an "on" condition the fuel pump will operate to deliver a continuous supply of fuel at a selected rate to the carburetor. Eventually, the fuel level will accumulate within the individual wells 91 until they become full and overflowing edge 92. The overflow fuel is received within the annular bowl 32 and is subsequently delivered through the drain tube 115 to the float chamber 116. When sufficient fuel has accumulated within the float chamber 116, the float will be raised and valve 118 opened to allow the overflow fuel to recycle back into the fuel tank tube 105 and subsequently to the fuel pump 102. Thus, when the engine is not in operation and the ignition is in the "on" position, the pump and fuel delivery means, in combination with the unrestricted flow means 103 and float valve means 114, will operate to continuously recirculate the fuel until the engine is started.

When the engine is started, the engine creates a suction that is transferred through the intake manifold to the mixing chamber area 43. If the second venturi member is in the idle condition as shown in FIGS. 1 and 6, the vacuum pressure is applied across the reduced area of the idle air means and the bypass duct(s) 140. This suction tends to draw air through the idle air grooves 71 which, in turn, lead across the outlet orifice 22 in FIG. 1 and both orifices 22 and 22*a* in FIG. 6. This air travels at relatively high velocity though not a large volume is allowed to pass because of the restricted cross-sectional throat area defined by the grooves 71 and 72. The pressure differential on opposite sides of the venturi members produces suction through the fuel suction tube means 21. The result is that fuel and air is drawn up through the tubes 134 and delivered through the associated ducts 139 to the premixing chamber(s) 149 where the fuel is vaporized and premixed with air. Subsequently, the charge enters the air duct 12 and is delivered to the mixing chamber 45 and moves on to the engine cylinders.

The apertures 135 in the suction tubes 134, 134*a* serve to initiate the air and fuel premixing process since both fuel and air are pulled into the tubes in response to vacuum from the engine. Turbulence within the enlarged premixing chamber(s) 149 and heat from water jacket 31 further facilitate premixing of the fuel and air before it enters the primary air moving through the idle air grooves 70. Thus, a relatively thorough mixture of fuel and air is delivered to the mixing chamber 43 and subsequently to the engine cylinders.

The fuel air mixture may be varied as to the quantity of air in relation to the quantity of fuel in the mixture by provision of the idle air adjusting means 74. The idle air adjustment means 74 may be slightly changed to increase or decrease the volume of air allowed to pass into the mixing chamber 43. By increasing the volume of air at idle condition, the corresponding suction produced through the premixing chamber(s) is reduced and less fuel is drawn through the suction tube means. That, the idle is set at a lean mixture. If, instead, the cross-sectional area is reduced, under idle conditions the corresponding effect is to transfer a greater suction force through the premixing chamber(s) into the suction tube means 21. As a result, more fuel is delivered to the premixing chamber(s) and out to the slightly more restricted air flow. Consequently, this results in a rich fuel mixture at idle conditions. Correct balancing of the vacuum in premixing chambers 149 can be easily accomplished.

When the throttle means is operated to bring the venturi members to an intermediate RPM range position (between the dashed line position and solid line position of the elements shown in FIG. 3) the idle air grooves are separated and air is allowed to enter the mixing chamber area is an annular cross section completely surrounding the second venturi member 16. Under full throttle condition more fuel is delivered to the air duct in proportion to the amount of air being drawn through the duct through operation of the mixture control means 20. This action also continues when the venturi members are in the wide open or full throttle position. The vacuum pressure within the annular premixing chambers, if too high or low, can be adjusted through the air bleed means 150. Selective adjustment of means 150 enables more or less air to be allowed to enter the premixing chamber 149 through the ducts 151 in response to vacuum from the engine. This therefore affects the negative pressure within the chamber and correspondingly affects the amount of fuel and air drawn through the suction tube means 21 under the various operating conditions.

The fuel mixture control means 20 may be designed to operate throughout the full range of conditions or just at the extremes — idle and full throttle. This is accomplished by varying the effective distance or "head" between the fuel level and the outlet orifice(s). Direct operation of the control means is accomplished through the throttle mechanism or by the barometric pressure sensing means 23. Both mechanisms serve to change the elevation of the fuel level in relation to the relatively stationary suction tubes. In doing so, the "head" pressure changes between the associated outlet orifice and the corresponding fuel level. In other words, by raising the fuel level over the suction tubes 134, the distance (elevational) between the level and the associated outlet orifice becomes less and therefore less pressure is required to lift the fuel to that level. Conversely, when the fuel level is lowered along the tubes 134, **134*a*** the distance is increased and a greater pressure is required to pull the fuel through the tubes to the outlet orifice.

Another factor affecting the amount of fuel delivery in response to operation of the mixture control means is that more of the apertures 135 become covered by fuel when the reservoir is raised to correspondingly raise the fuel level. Therefore more apertures are open to the raw fuel and fewer are open to the air above. Thus, less air will be entrained within the raw fuel being drawn through the tubes. But, when the fuel wells 91 are lowered to correspondingly lower the fuel level, more apertures 135 are exposed above the fuel level and will thus draw more air from within the vented chamber 32. A somewhat leaner and more thoroughly mixed charge is therefore delivered to the premix chamber 149.

The barometric pressure sensing means 23 operates solely to set the fuel level incidental to the altitudinal position of the carburetor. It is overriden by the operation of the throttle means. The barometric pressure sensing means operates to change the air-fuel ratio in response to less oxygenated air conditions of high elevations. Thus, an engine may be delivered an optimum fuel to air ratio in accordance with the oxygen content of the surrounding atmosphere.

It should be noted that even at full throttle position, the fuel level within wells 91 is constantly maintained by the fuel supply means 18. During full throttle operation, nearly all the fuel being delivered to the chambers is drawn through the air duct 12. In this condition, the fuel pump operates exactly as it does during idle conditions to deliver the regular continuous flow of fuel to the reservoir means at a rate that is equal to or slightly greater than the flow demanded by the open throttle condition. Thus, the fuel level will stay at the level determined by the height of the independent wells 91.

The continuous overflow is desirable especially in the form of the carburetor illustrated in FIGS. 6 and 7. Here, the central portion of the reservoir means necessarily operates on the overflow from the independent fuel wells 91. The level within the central reservoir portion will be maintained at an elevation equal to that of the discharge or drain tube 115. Therefore, the fuel level will stay at a constant level regardless of the axial position of the second venturi member 16. When the member 16 moves to the full throttle position (downwardly) the fuel level correspondingly raises with respect to the suction tubes **134*a*. Thus, a richer fuel mixture is also delivered to the outlet orifice 22*a***.

The outlet orifice **22*a* may be selectively adjusted through the aperture adjusting means 25. This is accomplished simply by turning the adjusting sleeve 155**. By turning the sleeve one way, the upper element of the venturi member is moved upwardly in relation to the lower element and the orifice correspondingly becomes larger. The enlarged orifice will allow passage of a larger volume of fuel therethrough and thus affect the overall air-fuel mixture by increasing the fuel portion of the ratio. Similarly, if the orifice is narrowed, a lower volume of fuel is allowed to pass and a leaner ratio results. Other adjustments in the air-fuel mixture ratio may be accomplished as discussed above.

It may have become obvious from the above description and attached drawings that modifications may be made therein. However, modifications may be contemplated that are necessarily discussed in the above description or shown in the accompanying drawings that do not depart from the scope of the invention. Therefore, only the following claims are to be taken as distinct restrictions on what I claim as my invention.

What I claim is:

1. A variable venturi carburetor for an internal combustion engine, comprising:

a hollow body defining a longitudinal open air duct leading from an open intake end to an open discharge end;

a first annular venturi surface in the duct;

a second annular surface in the duct coaxial to the first venturi surface with the venturi surfaces forming an annular restricted air passage therebetween within the air duct;

throttle means operatively connected to at least one of the venturi surfaces for axially moving the venturi surfaces relative to each other to increase or decrease the cross section of the annular restricted air passage;

fuel reservoir means for receiving and storing a volume of liquid fuel therein at a preselected liquid level;

said fuel reservoir means having a plurality of independent fuel wells angularly situated about the duct;

an annular fuel outlet orifice formed in one of the venturi surfaces coaxial with the air duct and openly communicating with the restricted air passage;

a plurality of upright fuel suction tubes projecting downwardly into respective fuel wells for receiving fuel therefrom and for delivering the fuel to the annular outlet orifice at angularly spaced locations; and fuel mixture control means operatively connected between the reservoir means and the tubes and responsive to the movement of the venturi surfaces relative to each other for varying the effective distance between the liquid level and the annular fuel outlet orifice to thereby vary the amount of fuel delivered to the annular fuel outlet orifice.

2. The carburetor as set out by claim 1 wherein more than one of the fuel suction tubes are perforated along their lengths such that perforations therein may be selectively exposed to an air space above the fuel level in response to operation of the mixture control means.

3. The carburetor as set out by claim 1 further including barometric pressure sensing means operatively associated with the fuel mixture control means for automatically adjusting the effective distance between the liquid level and outlet orifice in response to changes in the barometric pressure.

4. The carburetor as set out by claim 1 wherein the fuel mixture control means further comprises means for elevationally moving the fuel suction tubes in order to selectively vary the distance between the fuel level and the fuel outlet orifice.

5. The carburetor as set out by claim 1 further comprising an idle air means formed between the first and second venturi members; and idle air adjusting means on one of the venturi members for selectively varying the cross-sectional size of the idle air means.

6. The carburetor as set out by claim 1 further comprising a water jacket adapted to be connected to an engine water cooling system located in close proximity to the annular fuel outlet orifice.

7. The variable venturi carburetor as defined in claim 1 further comprising orifice adjusting means for selectively adjusting the width of the annular fuel outlet orifice.

8. The carburetor as set out in claim 1 wherein the outlet orifice connects the air duct with an annular enlarged premixing chamber that openly communicates with the suction tubes to receive fuel therefrom and delivers the fuel to the orifice.

9. The carburetor as defined in claim 8 further comprising air bleed means communicating with the premixing chamber for bleeding preselected amounts of air into the premixing chamber to control the vacuum pressure in the premixing chamber.

10. The carburetor as set out by claim 1 further comprising fuel supply means associated with the reservoir and adapted for connection to a fuel pump for maintaining the prescribed level of fuel within the reservoir regardless of the demand for fuel produced by an engine when the carburetor is mounted thereto.

11. The carburetor as set out by claim 10 wherein the fuel supply means includes unrestricted flow means for openly connecting the reservoir means to a fuel pump such that a continuous overflow of fuel from the reservoir means will be created in order to maintain the preselected fuel level regardless of engine demand.

12. The carburetor as set out by claim 11 wherein the fuel supply means includes a float valve means adapted for connection to a fuel pump for receiving the overflow fuel from the reservoir means and for delivering the overflow back to the fuel pump.

13. The carburetor as set out by claim 1 wherein the wells are axially movable and wherein the fuel mixture control means includes linkage attached to the fuel wells for moving them substantially vertically in relation to the suction tubes.

14. The carburetor as set out by claim 13 further comprising resilient biasing means for normally urging the fuel wells to a lowered position wherein a maximum length of the tubes are exposed to an air space above the wells and the effective distance between the fuel level within the wells and the orifice is at a maximum.

15. The carburetor as set out by claim 13 wherein the wells are connected to one another by an annular ring circumscribing the air duct and wherein the reservoir is situated within an annular chamber formed within the body and vented to the air duct.

16. A variable venturi carburetor for an internal combustion engine, comprising:

a hollow body defining a longitudinal open air duct leading from an open intake end to an open discharge end;

a first venturi member formed by an interior wall of the air duct;

a first annular fuel outlet orifice formed in the first venturi member in open communication with the air duct;

a second venturi member coaxially located within the air duct;

a second annular fuel outlet orifice formed in the second venturi member in open communication with the air duct;

throttle means for selectively moving the first and second venturi members axially relative to one another to thereby control the velocity and volume of air passing through the duct;

a first fuel means operatively connected to the first annular fuel outlet orifice for delivering fuel to the first annular outlet orifice;

a second fuel means operatively connected to the second annular outlet orifice;

wherein the first and second means includes a first and second reservoir means respectively for receiving and maintaining liquid fuel therein at a preselected level;

wherein the first and second fuel means includes fuel suction tube means leading from the associated first and second outlet orifices to the reservoir means for receiving and delivering fuel to the first and second outlet orifices;

wherein the first reservoir is formed of a plurality of independent fuel wells situated about the body and wherein the suction tube means includes an upright suction tube extending into each well.

17. The carburetor as set out by claim 16 wherein the first and second reservoir means are interconnected to maintain a constant fuel level in each reservoir.

18. The carburetor as set out by claim 16 wherein the wells are axially movable and wherein the fuel mixture control means includes linkage attached to the fuel wells for moving them substantially vertically in relation to the suction tubes.

19. The carburetor as defined by claim 16 wherein the first and second fuel supply means are comprised of first and second upright perforated tubes openly communicating with the first and second orifices respectively and extending into the first and second reservoir means respectively such that a portion of the perforations in the tubes may be selectively exposed to an air space above the fuel levels in response to operation of the fuel mixture control means to premix the fuel in the tubes.

20. The carburetor as set out by claim 16 further including barometric pressure sensing means operatively associated with the fuel mixture control means for automatically adjusting the effective distance between the liquid level and outlet orifice in response to outside air pressure changes at varying altitudes.

21. The carburetor as set out in claim 16 further comprising an orifice adjusting means associated with at least one of the orifices to selectively vary the orifice opening size at the air duct.

22. The carburetor as set out in claim 16 wherein at least one of the orifices is openly joined to an annular premixing chamber, said chamber being in open communication with the suction tube means; and an air bleed means is associated with the premixing chamber for allowing a preselected amount of outside air to enter the premixing chamber.

23. The carburetor as set out by claim 16 further including an idle air means formed between the first and second venturi members; and idle air adjusting means associated with the venturi members for selectively varying the cross-sectional size of the idle air passage.

24. The carburetor as set out by claim 16 further comprising a water jacket adapted to be connected to an engine water cooling system located in close proximity to the annular fuel outlet orifice.

25. The carburetor as set out by claim 16 further comprising:

fuel mixture control means operatively connected between at least one of the reservoir means and the corresponding suction tube means and responsive to movement of the venturi members relative to each other for varying the effective distance from the fuel level within each reservoir means to its respective outlet orifice.

26. The carburetor as set out by claim 25 wherein the suction tube means includes an upright perforated suction tube fixed to the second venturi member; wherein the second fuel reservoir means is stationary relative to the perforated suction tube such that it moves axially with the second venturi member in response to operation of the throttle means.

27. The carburetor as set out by claim 16 wherein the fuel supply means is openly connected with the first and second reservoir means and is adapted for connection to a fuel pump for maintaining a prescribed level of fuel within the reservoir regardless of the demand for fuel produced by an engine when the carburetor is mounted thereto.

28. The carburetor as set out by claim 27 wherein the fuel supply means includes unrestricted flow means for connection to a fuel pump such that a continuous flow of fuel can be received and delivered to the reservoir means to produce a continuous fuel overflow from the reservoir means regardless of engine demand.

29. The carburetor as set out by claim 28 wherein the fuel supply means further includes a float valve means adapted for connection to the fuel pump for receiving the overflow fuel from the reservoir and for delivering the overflow fuel to the fuel pump.

30. The carburetor as set out by claim 16 wherein the second venturi member is directly connected to the throttle means and is axially movable in response thereto and, wherein the carburetor further includes a low pressure equalizing means operatively connecting the second venturi member and carburetor body for equalizing vacuum pressure applied to the second venturi member from one direction toward the discharge end of the carburetor by creating a vacuum force acting against the second venturi member in an opposite direction.

31. The carburetor as set out by claim 30 further comprising an idle air means formed between the first and second venturi members; and idle air adjusting means associated with the venturi members for selectively varying the cross-sectional size of the idle air means.

32. The carburetor as recited by claim 30 further comprising fuel mixture control means operatively connected between the reservoir means and suction tube means and responsive to relative movment of the venturi members for varying the effective distance from the fuel level within the reservoir means to the outlet orifice.

33. The carburetor as set out by claim 32 wherein the suction tube means is comprised of a vertical hollow elongated tube openly communicating with the orifice and extending downwardly into the reservoir means, said tube being perforated along its length such that the perforations therein may be selectively exposed to an air space above the fuel level in response to operation of the mixture control means to premix air and fuel in the hollow tube.

34. The carburetor as set out by claim 32 wherein the outlet orifice is formed within the second venturi member and wherein the first venturi member also includes an annular horizontal fuel outlet orifice that is coaxial with the air duct and is interconnected through the suction tube means to the fuel reservoir means.

* * * * *